US008104883B2

(12) United States Patent
Okubo

(10) Patent No.: US 8,104,883 B2
(45) Date of Patent: Jan. 31, 2012

(54) LIQUID EJECTING HEAD AND LIQUID EJECTING APPARATUS

(75) Inventor: Katsuhiro Okubo, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 351 days.

(21) Appl. No.: 12/402,799

(22) Filed: Mar. 12, 2009

(65) Prior Publication Data

US 2009/0231379 A1 Sep. 17, 2009

(30) Foreign Application Priority Data

Mar. 13, 2008 (JP) ..... 2008-063747
Nov. 7, 2008 (JP) ..... 2008-286218

(51) Int. Cl.
*B41J 2/17* (2006.01)

(52) U.S. Cl. ..... 347/94; 347/68; 347/84

(58) Field of Classification Search ..... 347/5, 10, 347/68, 94
See application file for complete search history.

(56) References Cited

U.S. PATENT DOCUMENTS 6,554,406 B1 * 4/2003 Ohno et al. ..... 347/68
2007/0109373 A1 * 5/2007 Kojima ..... 347/94

FOREIGN PATENT DOCUMENTS

| | | |
|---|---|---|
| JP | 11-286110 | 10/1999 |
| JP | 2000-296617 | 10/2000 |
| JP | 2001-138511 | 5/2001 |
| JP | 2001-246748 | 9/2001 |
| JP | 2004-042559 | 2/2004 |
| JP | 2006-256006 | 9/2006 |
| JP | 2007-145014 | 6/2007 |

* cited by examiner

*Primary Examiner* — Lam S Nguyen
(74) *Attorney, Agent, or Firm* — Workman Nydegger

(57) ABSTRACT

There is provided a liquid ejecting head including a plurality of pressure generating chambers, a first substrate having a reservoir unit, and a second substrate having a compliance unit, the second substrate being combined with one surface of the first substrate via an adhesive layer. The reservoir unit has a first area and a second area whose width in a direction perpendicular to the arrangement direction of the pressure generating chambers is smaller than a width of the first area, the compliance unit is provided to seal the reservoir unit and the surrounding of the compliance unit is fixed by the adhesive layer, and a width of the compliance unit corresponding to the second area of the reservoir unit is formed so as to be larger than the width of the second area.

5 Claims, 10 Drawing Sheets

LIQUID EJECTING HEAD AND LIQUID EJECTING APPARATUS

BACKGROUND

1. Technical Field

The present invention relates to a liquid ejecting head and a liquid ejecting apparatus that eject liquid from a nozzle orifice, and in particular to an ink jet type recording head and an ink jet type recording apparatus that eject ink as liquid.

2. Related Art

There has been know an ink jet type recording head that is an example of a liquid ejecting head equipped with, for example, an actuator unit in which piezoelectric elements and pressure generating chambers are provided, and a channel unit equipped with a nozzle plate in which nozzle orifices that are communicated with the pressure generating chambers and that eject ink is provided and reservoir forming substrate in which a reservoir that becomes a common ink chamber of the pressure generating chambers is provided (for example, see JP-A-2004-042559 (pages 6 to 8, FIGS. 1 to 2).

In such a type of ink jet type recording head, when a pressure is applied to the ink in the pressure generating chamber, a pressure wave is generated in the pressure generating chamber. The pressure wave is transmitted to the reservoir communicated with the pressure generating chamber. The pressure wave is transmitted to another pressure generating chamber via the reservoir to cause unevenness of ink ejection property such as change of liquid drop speed.

In order to solve such a problem, a compliance unit having a thin film shape having flexibility is generally provided at an opening of the reservoir unit. The compliance unit serves as a pressure change absorption function (hereinafter, referred to as compliance) to absorb energy of the pressure wave (for example, see JP-A-2007-(pages 10-12, FIG. 4)).

On the other hand, there exist a reservoir that has a portion whose width is gradually reduced at the both end in the alignment direction of the pressure generating chambers. When the both ends of the reservoir in the alignment direction of the pressure generating chambers are formed by the same width as that of the other portion of the reservoir, flow speed of the ink supplied from the center becomes slow as the ink comes close to the both ends in the alignment direction of the pressure generating chambers, and this may cause retention of bubbles at the both ends. The retention of bubbles can be prevented by forming the both ends of the reservoir in the alignment direction of the pressure generating chambers so that the widths are gradually reduced.

The energy of the pressure wave caused by pressure change in each pressure generating chamber is absorbed by the compliance unit. It is known that the absorption amount has a correlation with the length (width) of the compliance unit in the direction perpendicular to the arrangement direction of the pressure generating chambers. When the compliance unit having the same shape as the reservoir is employed to the reservoir whose width is narrow, the width of the compliance unit in the direction perpendicular to the arrangement direction of the pressure generating chambers is also narrowed. Accordingly, the energy of the pressure wave caused by pressure change in each pressure generating chamber can not fully absorbed. Accordingly, in such an ink jet type recording head, good ink ejection property can not be obtained.

Note that such a problem exists not only in the ink jet type recording head, but also in a liquid ejecting head that ejects liquid except ink in the same manner.

SUMMARY (1) According to a first aspect of the invention, there is provided a liquid ejecting head including a plurality of pressure generating chambers that are communicated with corresponding one of nozzle orifices that eject liquid, the plurality of pressure generating chambers being arranged in parallel, a reservoir forming substrate having a reservoir unit constituting at east a part of a reservoir that is a common liquid chamber that supplies the liquid to the plurality of pressure generating chambers, and a compliance substrate having a compliance unit that absorbs pressure change, the compliance substrate being combined with one surface of the reservoir forming substrate via an adhesive layer. The reservoir unit is provided over the pressure generating chambers in an arrangement direction of the pressure generating chambers, and the reservoir unit has a first area and a second area whose width in a direction perpendicular to the arrangement direction of the pressure generating chambers is smaller than a width of the first area, the compliance unit is provided to seal the reservoir unit and the surrounding of the compliance unit is fixed by the adhesive layer, and a width of the compliance unit corresponding to the second area of the reservoir unit is formed so as to be larger than the width of the second area.

According to the first aspect of the invention, the adhesive layer in the area corresponding to the second area of the reservoir unit is provided so as to be apart outside from the end face of the second area by a predetermined distance, and the width of the compliance unit corresponding to the second area is formed larger than the width of the second area. It is known that the width of the compliance unit and an absorption amount of the energy of the pressure wave caused by pressure change of each pressure generating chamber has a positive correlation. Accordingly, the energy of the pressure wave cased by the pressure change of each pressure generating chamber can be well absorbed than before. Accordingly, a liquid ejecting head equipped with good liquid ejection property can be obtained.

(2) It is preferable that a distance between an end face of the reservoir unit and the adhesive layer in the second area becomes larger as the width of the reservoir unit becomes smaller in the first aspect of the invention.

In this case, the distance between the end face of the reservoir unit in the second area and the adhesive layer is gradually increased toward outside in the arrangement direction of the pressure generating chambers. Herewith, in the second area, the width of the compliance unit with respect to the second area is relatively gradually increased towered outside in the arrangement direction of the pressure generating chambers. Accordingly, the compensation amount of the compliance is also increased towered the distal end of the second area at which the compliance is insufficient. That is, shortage of the compliance is effectively compensated.

(3) It is preferable that the width of the compliance unit corresponding to an area of the reservoir unit that is opened to the pressure generating chambers is constant in the first aspect of the invention.

In this case, in the compliance unit, the width corresponding to the second area of the reservoir unit is formed so as to be the same as the width corresponding to the first area of the reservoir unit. Herewith, the deformation amount of the compliance unit in the second area becomes the same as the deformation amount of the compliance unit at the center of the reservoir unit in the arrangement direction of the pressure generating chambers. Accordingly, also in the second area, similarly to the first area, the energy of the pressure wave caused by presser change of each pressure generating chamber can be well absorbed.

Specifically, unevenness between the first area and the second area disappears in the absorption amount of the energy of the pressure wave cased by the pressure change of each pressure generating chamber. Accordingly, a liquid ejecting head that smoothes flow of ink by the second area of the reservoir unit and prevents retention of bubbles, and that has good ink ejection property can be obtained.

Note that "the constant" means not the constant in a strict sense and may include some error.

(4) It is preferable that a distance between one end face of the reservoir unit in the second area in the direction perpendicular to the alignment direction of the pressure generating chambers and the adhesive layer outside the end face and a distance between the other end face and the adhesive layer outside the other end face are the same in the first aspect of the invention.

In this case, the distance between one end face of the reservoir unit in the second area and the adhesive layer outside thereof, and the distance between the other end face and the adhesive layer outside thereof in a cross section in the direction perpendicular to the arrangement direction of the pressure generating chambers are set so as to be the same. Herewith, the compliance unit is provided so that each of the ends in the second area is apart from each of the end faces in the second area perpendicular to the arrangement direction of the pressure generating chambers by the same distance in the direction perpendicular to the arrangement direction of the pressure generating chambers. When the compliance unit is provided in this manner, it is prevented that bubbles are retained at any one side of the compliance unit in the direction perpendicular to the arrangement direction of the pressure generating chambers. Accordingly, bubbles can be speedy discharged even when bubbles are generated in the reservoir unit.

Note that "the same" means not the same in a strict sense and may include some error.

According to a second aspect of the invention, there is provided a liquid ejecting apparatus comprising the liquid ejecting head according to the first aspect of the invention.

(5) According to the second aspect of the invention, ink ejection property is improved and uniformized and the ink jet type recording apparatus whose print quality is improved can be obtained.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments will be described in detail with reference to the accompanying drawings.

First Embodiment

Figure 1:
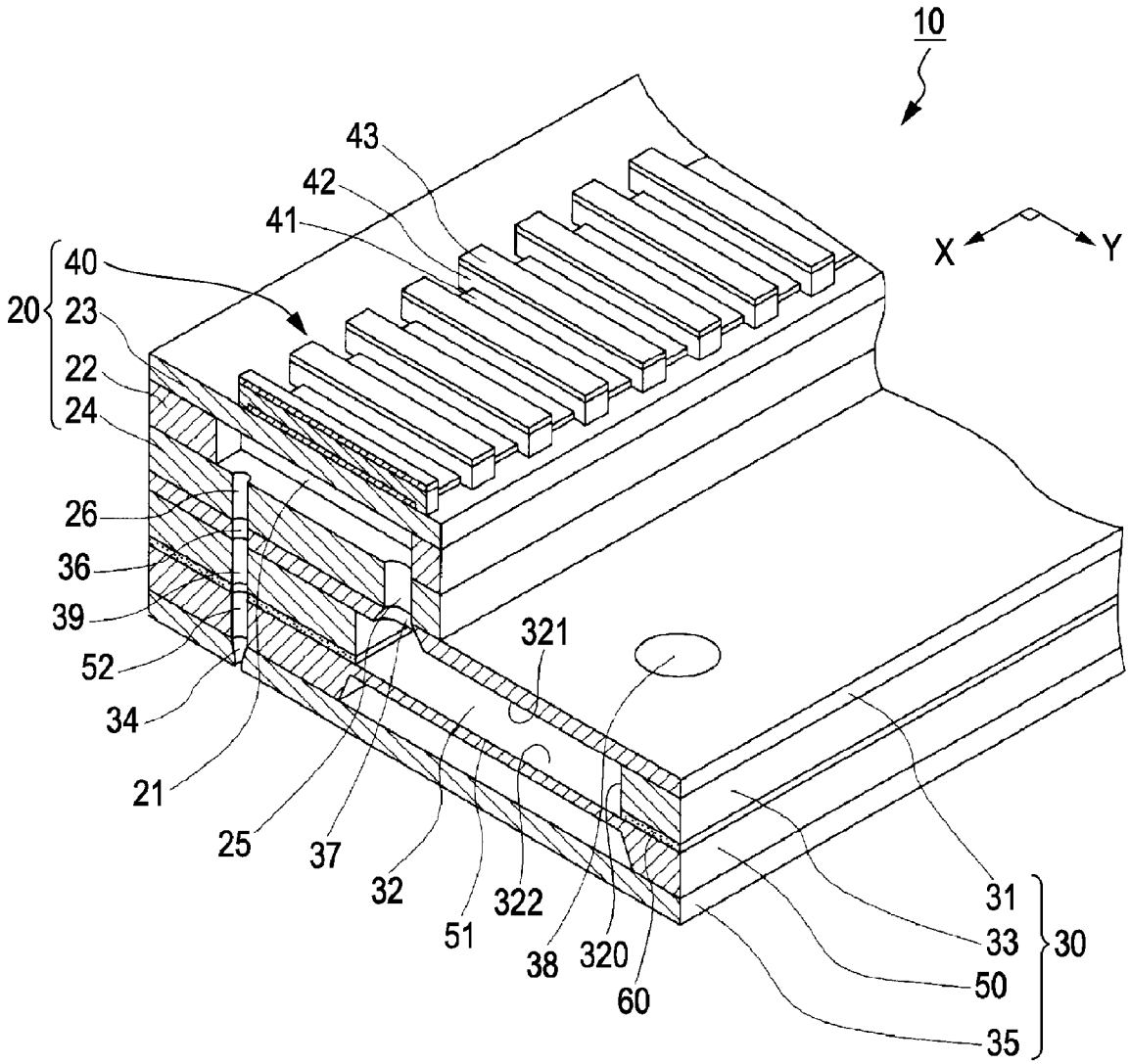
FIG. 1 is a cut-out perspective view showing a main portion of an ink jet type recording head according to a first embodiment.

FIG. 1 is a cut-out perspective view showing a main portion of an ink jet type recording head 10 as a liquid ejecting head of the embodiment.

Figure 2:
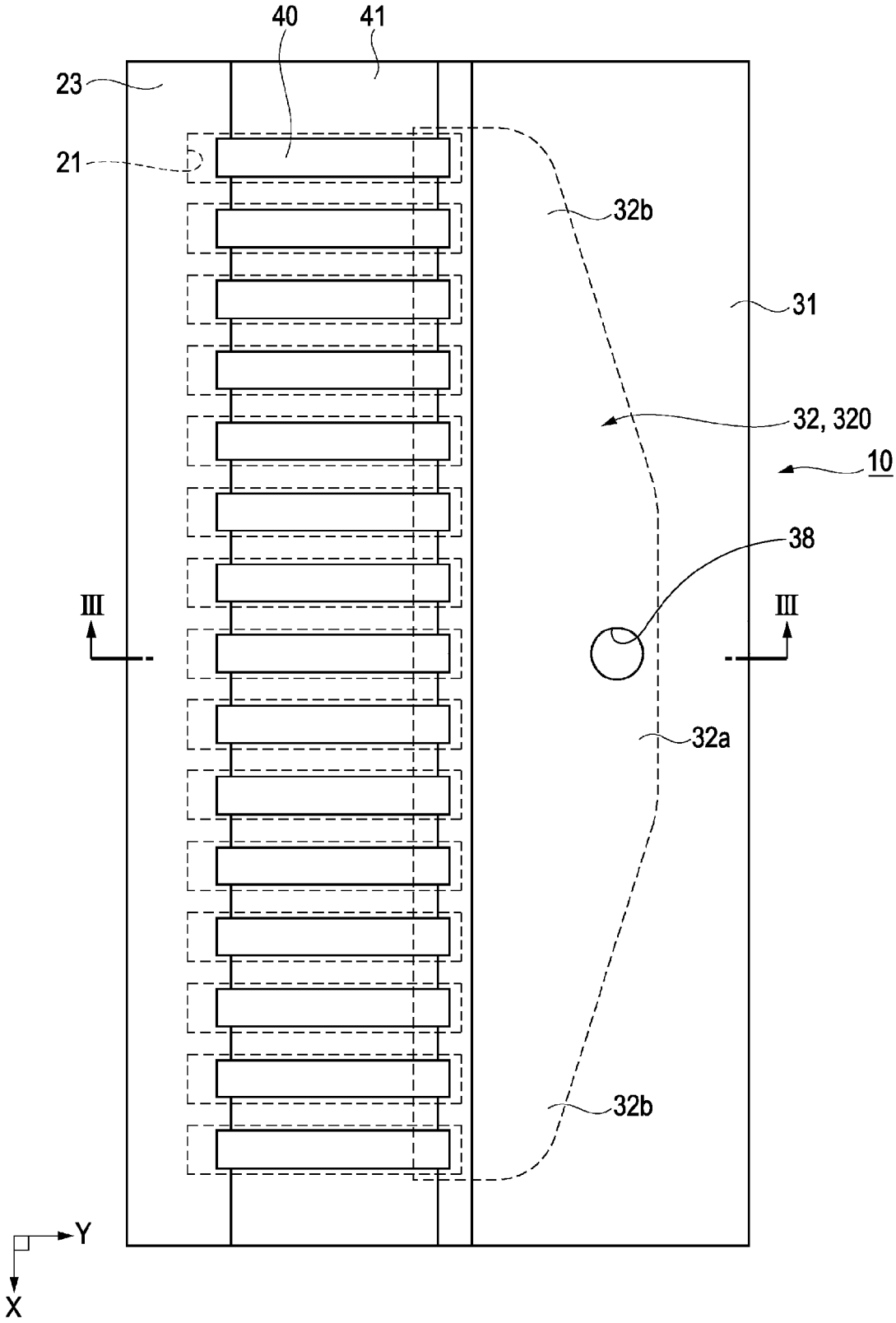
FIG. 2 is a plan view showing the ink jet type recording head.
Figure 3:
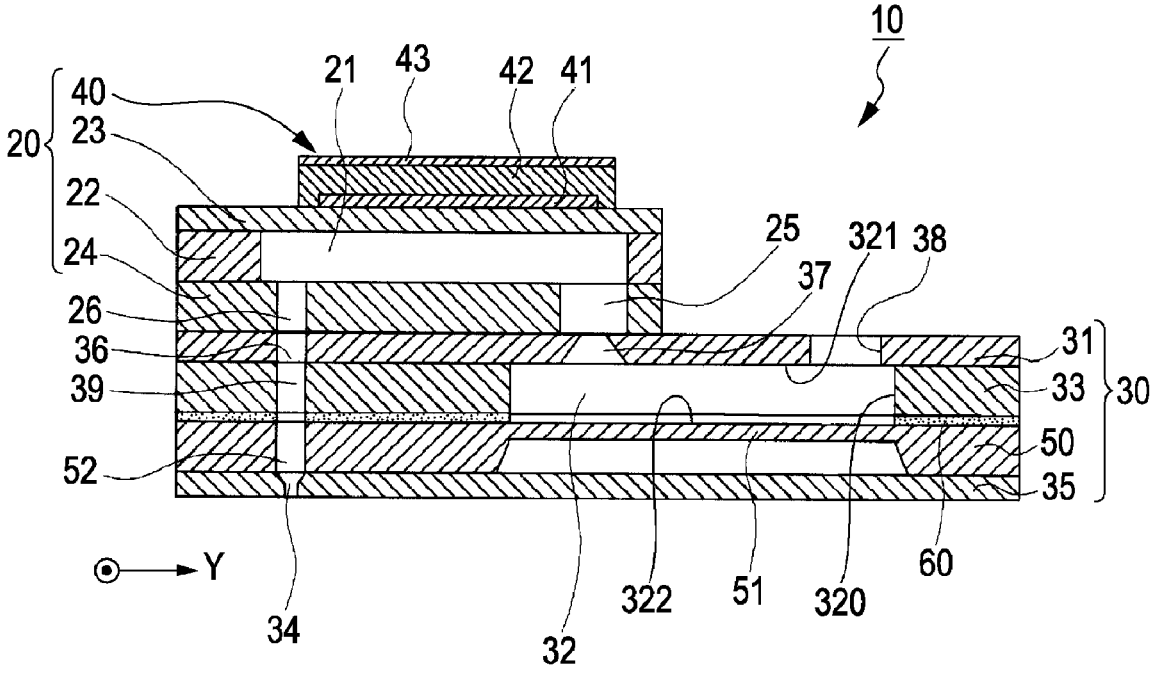
FIG. 3 is a cross sectional view taken along the line III-III of FIG. 2.

FIG. 2 is a plan view showing the ink jet recording head. FIG. 3 is a cross sectional view taken along the line III-III of FIG. 2.

In FIGS. 1 to 3, the ink jet type recording head 10 of the embodiment is equipped with an actuator unit 20, and a channel unit 30 to which the actuator unit 20 is fixed.

The actuator unit 20 is an actuator device equipped with piezoelectric elements 40. The actuator unit 20 is equipped with a channel forming substrate 22 in which pressure generating chambers 21 are formed, a diaphragm 23 provided at one face side of the cannel forming substrate 22, and a pressure generating chamber bottom plate 24 provided at the other face side of the channel forming substrate 22.

A plurality of the pressure generating chambers 21 are formed in the channel forming substrate 22 so as to be arranged in parallel. In FIGS. 1 to 3, the arrangement direction is shown as the X axis direction and the direction perpendicular to the arrangement direction is shown as the Y axis direction. The pressure generating chamber 21 has a elongated shape whose longitudinal direction is the Y axis direction.

The channel forming substrate 22 is made of, for example, a ceramic plate such as alumina ($AL_2O_3$), zirconia ($ZrO_2$), or the like whose thickness is about 150 μm.

The diaphragm 23 made of a thin plate of zirconia whose thickness is 10 μm is fixed to one face of the channel forming substrate 22, and one face of the pressure generating chamber 21 is formed by the diaphragm 23. The pressure generating chamber bottom plate 24 is fixed to the other face side of the channel forming substrate 22, and the other face of the pressure generating chamber 21 is formed by the pressure generating chamber bottom plate 24.

A supply communication hole 25 that is provided near one end of the pressure generating chamber 21 in the Y axis direction and that communicates the pressure generating chamber 21 and a reservoir 32 to be described below, and a nozzle communication hole 26 that is provided near the other end of the pressure generating chamber 21 in the Y axis direction and that is communicated with a nozzle orifice 34 to be described below are formed in the pressure generating chamber bottom plate 24.

The piezoelectric element 40 is provided in each area opposing each pressure generating chamber 21 on the diaphragm 23. The piezoelectric element 40 is equipped with a lower electrode film 41 provided on the diaphragm 23, a piezoelectric body layer 42 independently provided for each pressure generating chamber 42, and an upper electrode layer 43 provided on each piezoelectric body layer 42.

The piezoelectric body layer 42 is formed by attaching or printing a green sheet made of a piezoelectric material. The lower electrode film 41 is provided over the piezoelectric body layers 42 arranged in parallel, and forms a common electrode of each piezoelectric element 40. The lower electrode film 41 functions as a part of the diaphragm. Note that the lower electrode film 41 may be provided for each piezoelectric body layer 42.

Note that the channel forming substrate 22, the diaphragm 23, and the pressure generating chamber bottom plate 24 which are each layer of the actuator unit 20 are obtained by forming a clayey ceramic material, so called a green sheet, to have a predetermined thickness, and, for example, by making the pressure generating chamber 21 and the like by drilling. By laminating and burning the obtained each layer, the layers can be integrated without an adhesive agent. Then, the actuator unit 20 can be obtained by forming the piezoelectric elements 40 on the oscillator 23.

The channel unit 30 is equipped with a fluid supply port forming substrate 31 combined to the pressure generating chamber bottom plate 24 of the actuator unit 20, a reservoir forming substrate 33 in which the reservoir unit 320 constituting at least a part of the reservoir 32 that becomes an ink chamber that is a common liquid chamber of the plurality of pressure generating chambers 21 is formed, a compliance substrate 50 provided at the side opposite to the liquid supply port forming substrate 31 of the reservoir forming substrate 33, and a nozzle plate 35 in which a nozzle orifice 34 is formed.

The liquid supply port forming substrate 31 is made of a thin plate of SUS whose thickness is 60 μm, and a nozzle communication hole 36 that connects the nozzle orifice 34 and the pressure generating chamber 21 and a liquid supply port 37 that connects the reservoir 32 and the pressure generating chamber 21 with the supply communication hole 25 are drilled. Further, a liquid introduction port 38 that is communicated with the reservoir 32 and that supplies ink from an exterior ink tank not shown is provided.

The liquid supply port 37 is provided so as to be communicated with an end of the reservoir 32 at the side of reservoir 32 in the Y axis direction of the pressure generating chamber 21.

Further, in FIG. 2, the liquid introduction port 38 is provided at approximately the center of the reservoir 32 in the X axis direction and at an end opposite to the side of the pressure generating chambers 21 arranged in parallel.

The reservoir forming substrate 33 is made of a plate material having corrosion resistance that is adequate for constituting ink channel, for example, such as stainless steel whose thickness is 150 μm. The reservoir unit 320 constituting a part of the reservoir 32 that receives supply of ink from the outer ink tank and that supplies the ink to the pressure generating chamber 21, and a nozzle communication hole 39 that communicates the pressure generating chamber 21 and the nozzle orifice 34 are formed in the reservoir forming substrate 33.

The reservoir unit 320 is provided over the pressure generating chambers 21 arranged in parallel in the X axis direction. In the embodiment, the reservoir unit 320 is provided so as to pass through the reservoir forming substrate 33 in the thickness direction, and is opened at the side of the liquid supply port forming substrate 31 and the side of the compliance substrate 50.

Hereinafter, the reservoir 32 will be described in detail.

In FIGS. 1 to 3, the reservoir unit 320 is formed in the reservoir forming substrate 33, and an upper surface 321 of the reservoir 32 is formed by the liquid supply port forming substrate 31, and a lower surface 322 of the reservoir 32 is formed by the compliance substrate 50.

In FIG. 2, the reservoir 32 and the reservoir unit 320 have a first area 32*a* and a second area 32*b*.

The first area 32*a* is an area that extends in the both direction of the X axis of the pressure generating chamber 21 from the liquid introduction port 38 as the center that is positioned at approximately the center of the reservoir 32 and the reservoir unit 320 in the X axis direction.

The second area 32*b* is an area positioned at the both sides of the first area 32*a*. The width of the second area 32*b* in the Y axis direction is smaller than the width of the first area 32*a* in the Y axis direction. The width of the second area 32*b* becomes gradually reduced as becomes close to the both ends of the reservoir 32 and the reservoir unit 320. This is to uniform the flow speed of ink supplied from the liquid introduction port 38.

In FIGS. 1 and 3, the compliance substrate 50 has a compliance unit 51 that is flexurally deformed by pressure change in the reservoir 32, and the compliance substrate 50 is combined to the surface of the reservoir forming substrate 33 opposite to the liquid supply port forming substrate 31 via an adhesive layer 60.

Specifically, the compliance substrate 50 is combined so as to seal the opening of the reservoir unit 320 by the compliance unit 51. The compliance unit 51 is constituted by a part of the compliance substrate 50, and the thickness of the compliance unit 51 is thinner than other part of the compliance substrate 50. A nozzle communication hole 52 that communicates the nozzle communication hole 39 provided in the reservoir forming substrate 33 so as to pass through in the thickness direction and the nozzle orifice 34 is provided in the compliance substrate 50.

As a material of the compliance substrate 50, for example, a metal such as stainless steel or a ceramic can be used. Of course, the compliance substrate 50 is not limited to this, and may be constituted by, for example, an elastic film having a film shape constituting the compliance unit 51 and a support substrate in which a part is passed through in the thickness direction.

The nozzle plate 35 is formed by a thin plate made of, for example, stainless steel, and nozzle orifices 34 for ejecting ink are drilled by the same arrangement pitch as that of the pressure generating chambers 21.

The channel unit 30 as described above is formed by fixing the liquid supply port forming substrate 31, the reservoir forming substrate 33, the compliance substrate 50, and the nozzle plate 35 by an adhesive layer, a hot welded film, or the like. The channel unit 30 and the actuator unit 20 are combined to be fixed via an adhesive layer or a hot welded film.

Figure 4:
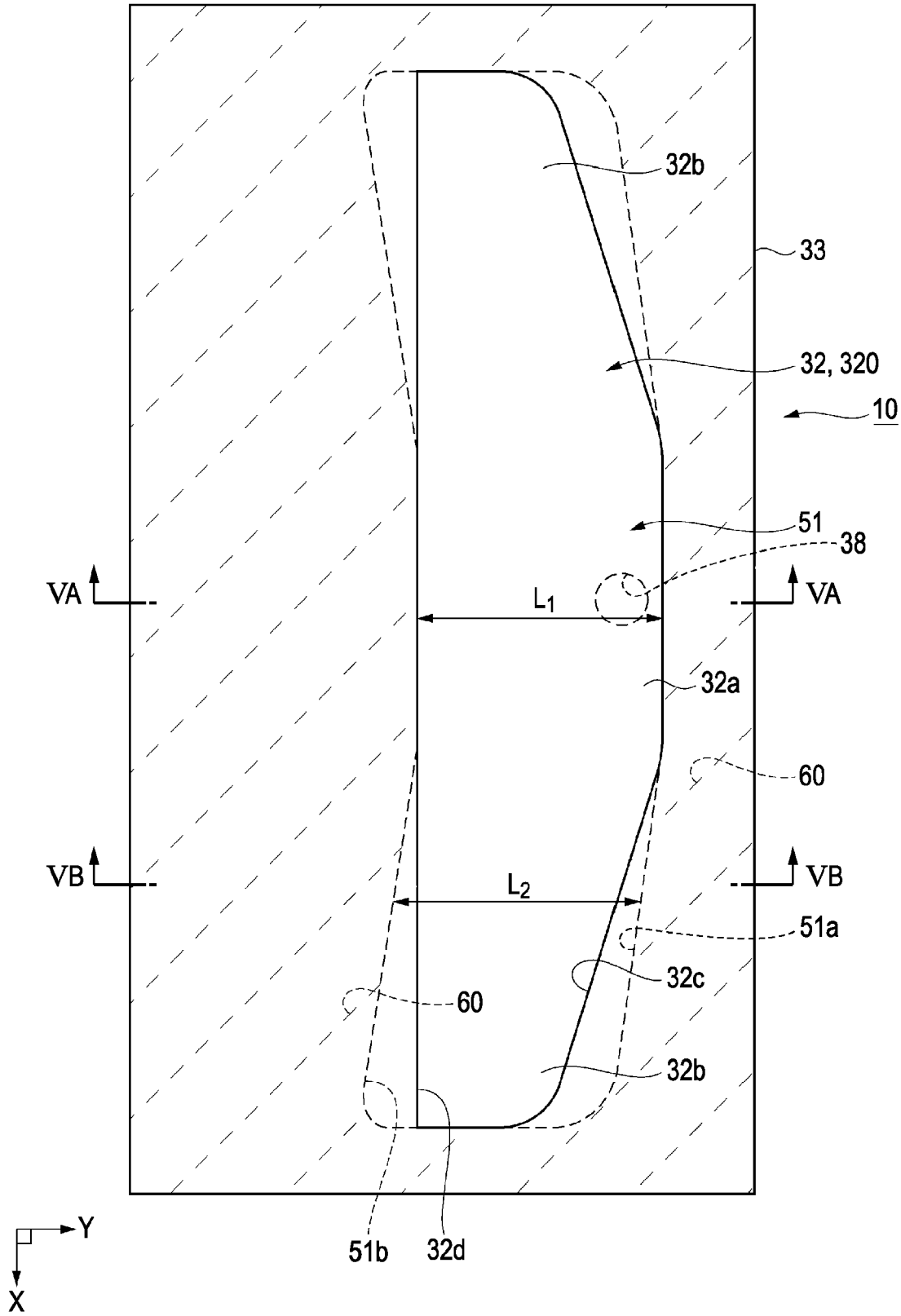
FIG. 4 is a plan view showing a main portion of the ink jet type recording head.
Figure 5A:
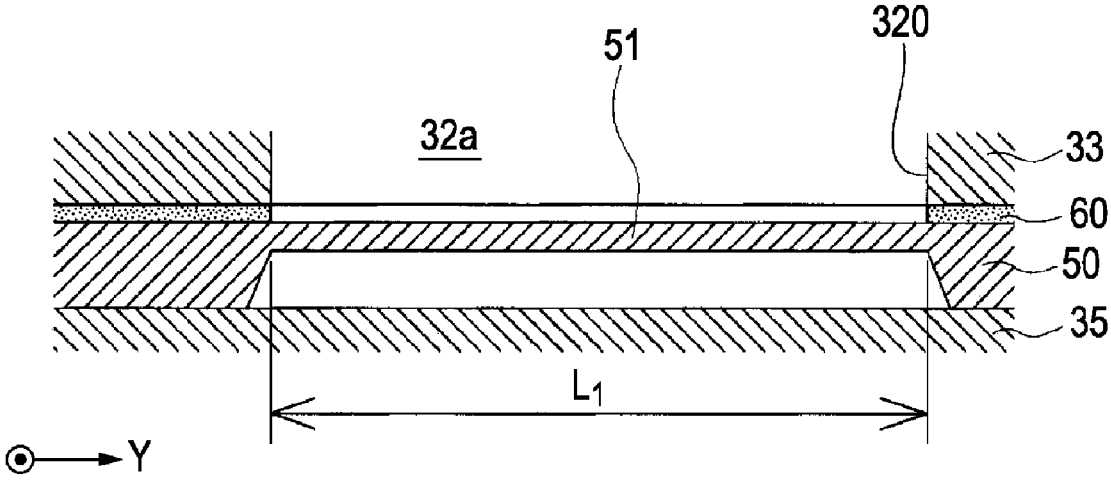
FIG. 5A is a main portion enlarged cross sectional view taken along the line VA-VA of FIG. 4.

Herein, the reservoir unit 320 and the compliance unit 51 will be described more in detail with reference to FIGS. 4, 5A, and 5B. FIG. 4 is a plan view showing a main portion of the planer shape of the reservoir unit 320 and the compliance unit 51. FIG. 5A is a main portion enlarged cross sectional view taken along the line VA-VA of FIG. 4, and FIG. 5B is a main portion enlarged cross sectional view taken along the line VB-VB of FIG. 4.

In FIG. 4, the reservoir unit 320 of the embodiment has the second area 32*b* at the both end in the X axis direction that is the arrangement direction of the pressure generating chambers 21. The width of the second area 32*b* is gradually reduced toward the outer side in the X axis direction.

Figure 5B:
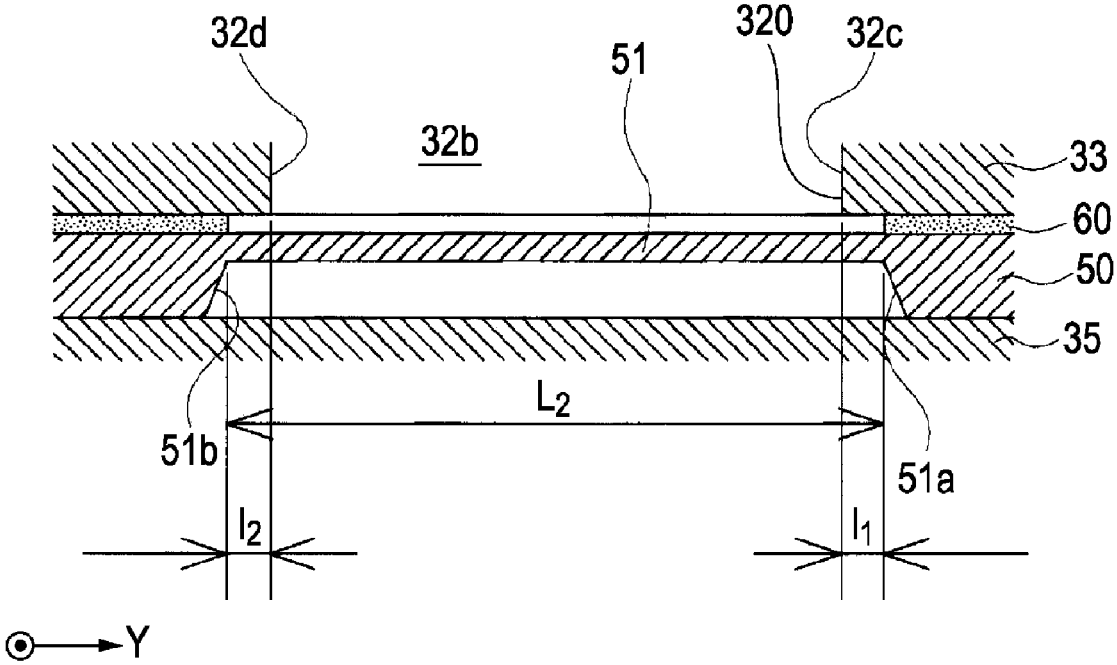
FIG. 5B is a main portion enlarged cross sectional view taken along the line VB-VB of FIG. 4.

On the other hand, in FIGS. 5A, 5B, the compliance unit 51 is provided so as to seal the opening of the reservoir unit 320, and the surrounding is fixed by the adhesive layer 60. The adhesive layer 60 is provided so as to be apart outside from the end face of the second area 32*b* by a predetermined distance in an area corresponding to the second area 32*b* of the reservoir unit 320. The adhesive layer 60 is provided at the marginal portion of the reservoir unit 320 in an area corresponding to the first area 32*a* of the reservoir unit 320.

In FIG. 4, the width of the compliance unit 51 corresponding to the second area 32*b* is also formed larger than the width of the second area 32*b*.

Further, in FIGS. 4, 5A, and 5B, distances $l_1$ and $l_2$ between end faces 32*c* and 32*d* of the reservoir 320 and the adhesive layer 60 in the second area 32*b* are gradually increased toward the outer side in the Y axis direction. In other ward, the adhesive layer 60 in the second area 32*b* is provided so as to be gradually apart from the end faces 32*c* and 32*d* of the second area 32*b* in the Y axis direction toward the outer side in the X axis direction.

The compliance unit 51 is also provided so that each of ends 51*a*, 51*b* is gradually apart from each end face 32*c*, 32*d* in the second area 32*b* in the Y axis direction toward the outer side in the X axis direction.

Further, in FIGS. 4, 5A, and 5B, in the compliance unit 51 of the embodiment, the width $L_2$ corresponding to the second area 32*b* of the reservoir unit 320 is formed to be the same as the width $L_1$ corresponding to the first area 32*a* of the reservoir unit 320. Note that "the same" means not the same in a strict sense and may include some error.

Further, the distance $l_1$ between one end face 32*c* of the reservoir unit 320 in the second area 32*b* and the outside adhesive layer 60 and the distance $l_2$ between the other end face 32*d* and the outside adhesive layer 60 in a cross section in the Y axis direction of the pressure generating chambers 21 are the same.

The compliance unit 51 is also provided so that each of ends 51*a*, 51*b* corresponding to the second area 32*b* are respectively apart from each end face 32*c*, 32*d* of the reservoir unit 320 in the second area 32*b* in the Y axis direction by the same distance.

Further, the compliance unit 51 is provided so as not to interfere with the marginal portion of the opening of the reservoir unit 320 also in the second area 32*b* of the reservoir unit 320 when deformed by pressure change in the reservoir 32. That is, the width of the second area 32*b* of the reservoir unit 320 in the Y axis direction is smaller than that of the other portion, so that when the compliance unit 51 is flexurally deformed, the opening of the reservoir unit 320 and the compliance unit 51 may be easily interfered. However, in the embodiment, interference between the compliance unit 51 and the opening of the reservoir unit 320 is prevented in the second area 32*b*.

Specifically, interference between the compliance unit 51 and the marginal portion of the reservoir unit 320 in the second area 32*b* can be prevented by increasing the thickness of the adhesive layer 60 to a level so that the compliance unit 51 and the marginal portion of the reservoir unit 320 are not interfered.

Note that as shown in FIG. 4, the planar shape of the compliance unit 51 is formed to be the same as the planar shape of the adhesive layer 60 on the reservoir unit 320. This relation may be provided by preliminarily forming the portion of the compliance substrate 50 that is thinly formed so as to have the same shape as the adhesive layer 60. This relation may be also provided by forming the portion of the compliance substrate 50 that is thinly formed so as to be larger than the adhesive layer 60 and by bonding the adhesive layer 60 on the thin portion. In this case, the area of the thinly formed portion of the compliance substrate 50 surrounded by the adhesive layer 60 is regarded as the compliance unit 51.

Note that when the portion of the compliance substrate 50 that is thinly formed is formed to have the same shape as the adhesive layer 60, it is not necessary that the adhesive layer 60 is continuously provided as far as the adhesive layer 60 is provided to fix the surrounding of the compliance unit 51.

In the ink jet type recording head 10 having such a structure, ink is introduced in the reservoir 32 from the ink tank via the liquid introduction port 38, and the ink channel is filled with the ink from the reservoir 32 to the nozzle orifice 34. Then, a voltage is applied to each piezoelectric element 40 corresponding to each pressure generating chamber 21 in accordance with a recording signal from a driving circuit not shown to flexurally deform the oscillator 23 with the piezoelectric element 40. Herewith, the pressure in each pressure generating chamber 21 is increased and an ink drop is ejected from each nozzle orifice 34. At this time, a pressure wave generated in the pressure generating chamber 21 and transmitted to the reservoir 32 is well absorbed by the compliance unit 51.

According to such an embodiment, the effects described below can be obtained.

(1) The adhesive layer 60 in the area corresponding to the second area 32*b* of the reservoir unit 320 is provided so as to be apart outside from the end face of the second area 32*b* by a predetermined distance, and the width of the compliance unit 51 corresponding to the second area 32*b* is formed larger than the width of the second area 32*b*. It is known that the width of the compliance unit 51 and an absorption amount of the energy of the pressure wave caused by pressure change of each pressure generating chamber 21 has a positive correlation. Accordingly, according to the structure of the ink jet type recording head 10 of the embodiment, the energy of the pressure wave cased by the pressure change of each pressure generating chamber 21 can be well absorbed than before.

(2) The distances $l_1$ and $l_2$ between the end faces 32*c* and 32*d* of the reservoir unit 320 in the second area 32*b* and the adhesive layer 60 are gradually increased toward outside in the arrangement direction of the pressure generating chambers 21. Herewith, in the second area 32*b*, the width of the compliance unit 51 with respect to the second area 32*b* is relatively gradually increased toward outside in the arrangement direction of the pressure generating chambers 21. Accordingly, the compensation amount of the compliance is also increased towered the distal end of the second area 32*b* at which the compliance is insufficient. That is, according to the ink jet type recording head 10, shortage of the compliance is effectively compensated.

(3) In the compliance unit 51, the width L2 corresponding to the second area 32*b* of the reservoir unit 320 is formed so as to be the same as the width L1 corresponding to the first area 32*a* of the reservoir unit 320. Herewith, also in the second area 32*b*, the energy of the pressure wave caused by pressure change of each pressure generating chamber 21 can be well absorbed similarly to the first area 32*a*. Specifically, unevenness between the first area 32*a* and the second area 32*b* disappears in the absorption amount of the energy of the pressure wave cased by the pressure change of each pressure generating chamber 21. Accordingly, according to the structure of the embodiment, not only flow of ink is smoothed by the second area 32*b* of the reservoir unit 320 and retention of bubbles can be prevented, but also good ink ejection property can be obtained.

(4) The distance $l_1$ between one end face 32*c* of the reservoir unit 320 in the second area 32*b* and the adhesive layer 60 outside thereof, and the distance $l_2$ between the other end face 32*d* and the adhesive layer 60 outside thereof in a cross section in the direction perpendicular to the arrangement direction of the pressure generating chambers 21 are set so as to be the same. Herewith, the compliance unit 51 is provided so that each of the ends 51*a*, 51*b* in the second area 32*b* is apart from each of the end faces 32*c*, 32*d* in the second area 32*b* perpendicular to the arrangement direction of the pressure generating chambers 21 by the same distance in the Y axis direction. When the compliance unit 51 is provided in this manner, it is prevented that bubbles are retained at any one side of the compliance unit 51 in the direction perpendicular to the arrangement direction of the pressure generating chambers 21. Accordingly, there is also an effect that bubbles can be speedy discharged even when bubbles are generated in the reservoir unit 320.

Modification

Figure 6:
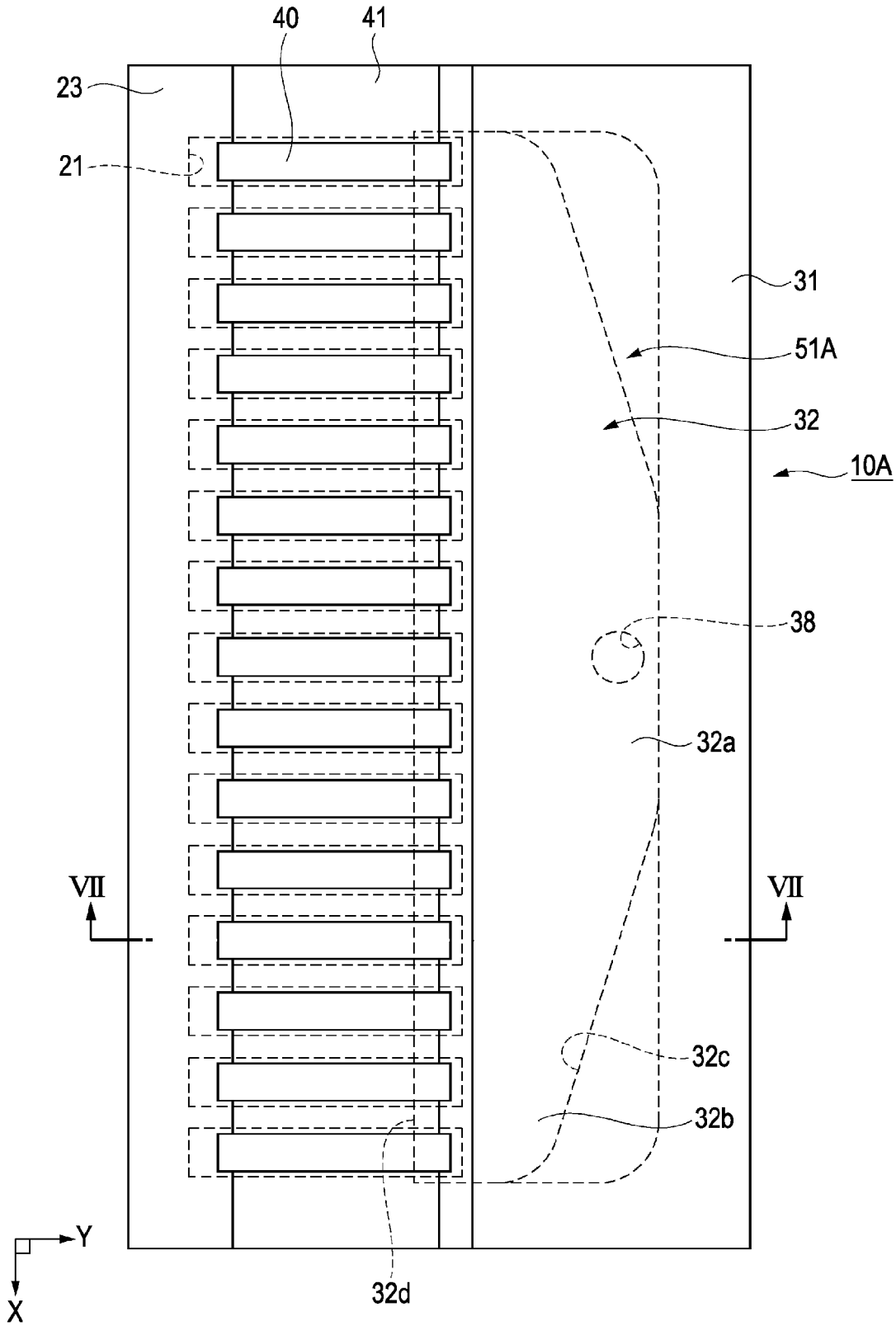
FIG. 6 is a plan view showing a main portion of an ink jet type recording head according to a modification.
Figure 7:
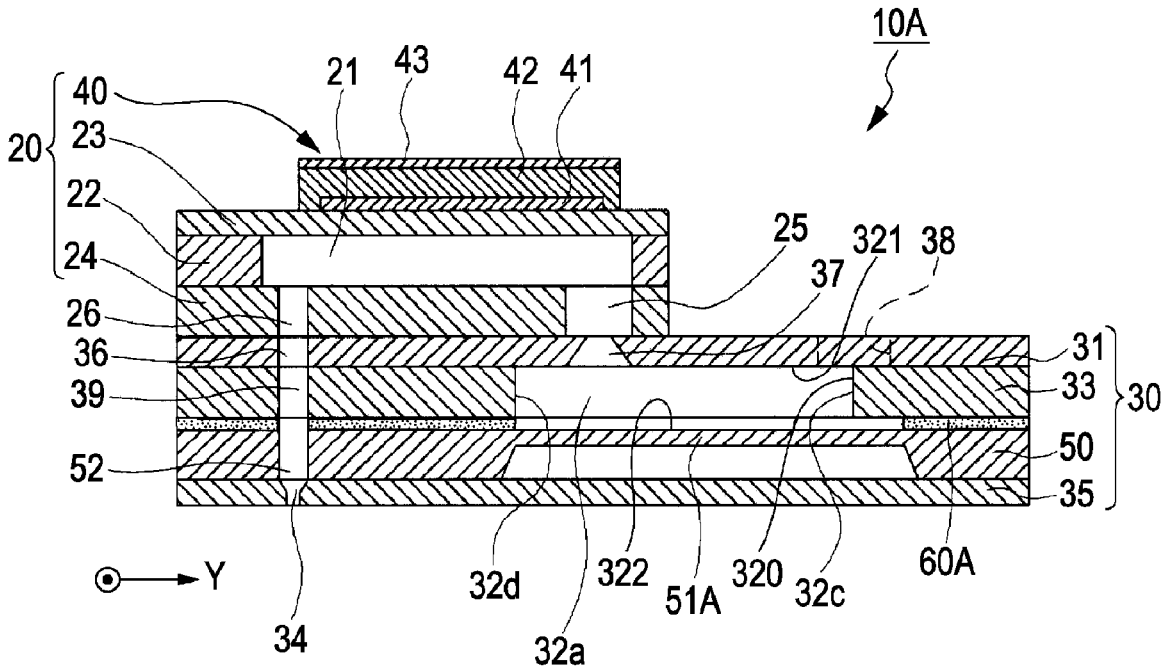
FIG. 7 is a cross sectional view taken along the line VII-VII of FIG. 6.

FIG. 6 is a plan view showing an ink jet type recording head 10A according to a modification. FIG. 7 is a cross sectional view taken along the line VII-VII of FIG. 6.

In FIGS. 6, 7, a compliance unit 51A and an adhesive layer 60A in the second area 32*b* are respectively provided so as to be apart from each of the end face 32*c* and the end face 32*d* of the second area 32*b* by different distances in the Y axis direction.

As in the modification, the compliance unit 51A of the second are 32*b* may be provided so as to be shifted at the side of the end face 32*c* of the second area 32*b*. Alternatively, the compliance unit 51A may be provided so as to be shifted at the side of the end face 32*d*.

Second Embodiment

Figure 8:
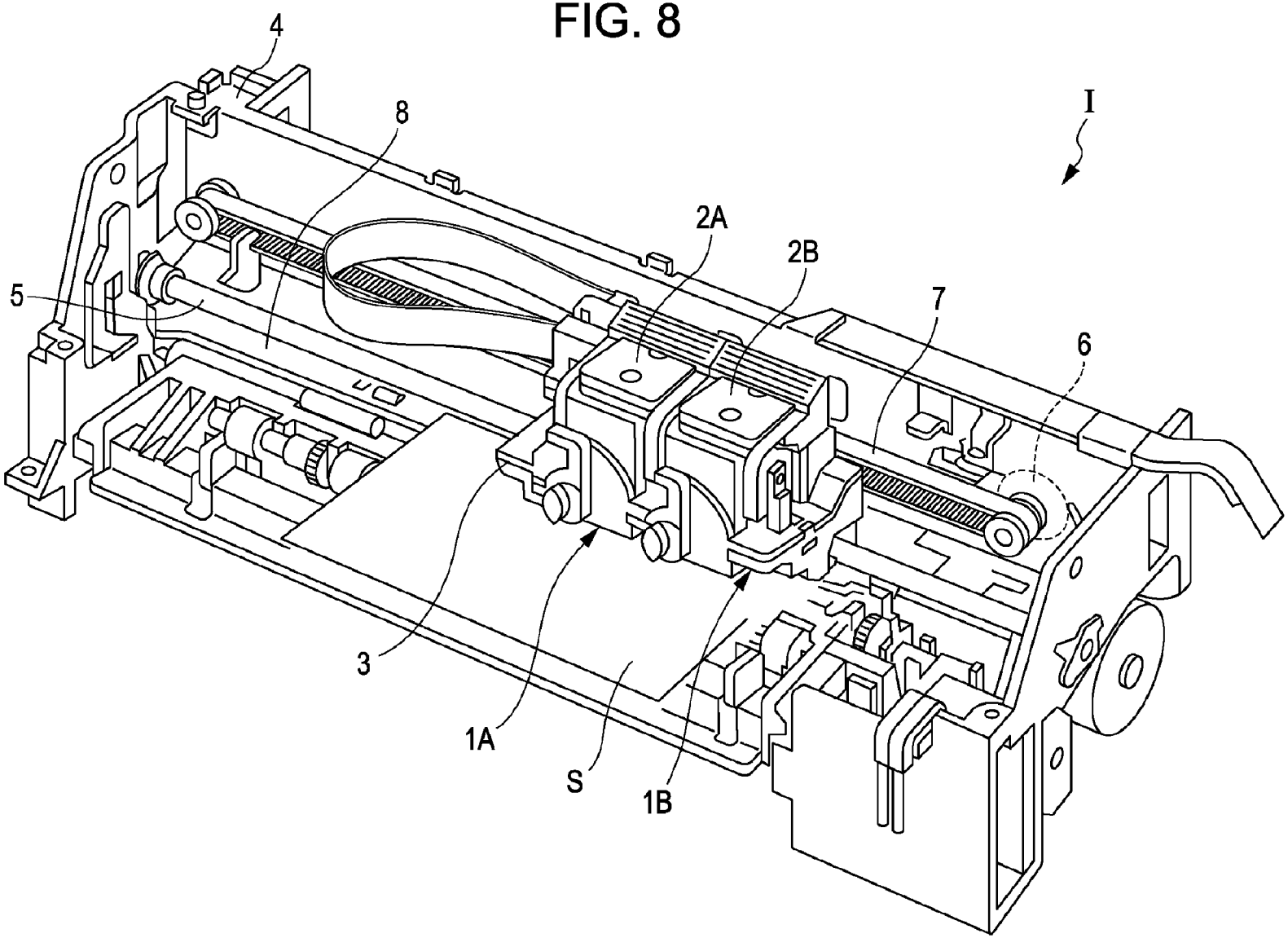
FIG. 8 is a diagram schematically showing an ink jet type recording apparatus according to the embodiment and the modification.

FIG. 8 is a diagram schematically showing an example of an ink jet type recording apparatus I according to the embodiment.

The ink jet type recording heads 10, 10A of the first embodiment and the modification constitute a part of recording head units 1A, 1B that are equipped with an ink channel communicated with a cartridge or the like that is an ink tank, and are mounted in the ink jet type recording apparatus I that is a liquid ejecting apparatus.

In FIG. 8, in the recording head units 1A, 1B of the ink jet type recording apparatus I, cartridges 2A and 2B as ink tanks constituting ink supply means are detachably provided. A carriage 3 on which the recording head units 1A and 1B are mounted is provided on a carriage axis 5 attached to a device main body 4 so as to be moved in the axis direction. The recording head units 1A and 1B respectively ejects, for example, a black ink composition and a color ink composition.

A driving force of a driving motor 6 is transmitted to the carriage 3 via a plurality of gears not shown and a timing belt 7. Herewith, the carriage 3 on which the recording head units 1A and 1B are mounted are moved along the carriage axis 5.

On the other hand, a platen 8 is provided along the carriage axis 5 of the device main body 4, and a recording sheet S that is a recording medium such as a paper that is supplied by a paper feed roller or the like not shown is wound on the platen 8 to be transported.

According to the embodiment, the effects described below can be obtained.

(5) Ink ejection property is improved and uniformized and the ink jet type recording apparatus I whose print quality is improved can be obtained.

Various modifications can be made to the embodiments and the modification. In the embodiments, the width of the compliance unit 51 in the second area 32*b* and the width of the compliance unit 51 in the first area 32*a* are formed so as to be the same. However, the widths may not be the same as in the modification.

That is, it is not necessary that the width of the compliance unit 51 in the second area 32*b* and the width of the compliance unit 51 in the first area 32*a* are the same as far as the dimensions of the compliance unit 51 in the second area 32*b* is larger than the dimensions in the second area 32*b* by providing the adhesive layer 60 in the second area 32*b* so as to be apart from the end face 32*c* or 32*d* in the second area 32*b* by a predetermined distance. Even when the widths are not the same, the deformation amount of the compliance unit 51 in the second area 32*b* is increased than before, and good ink ejection property can be obtained.

Further, in the embodiments, the second area 32*b* is provided at the both ends of the reservoir 32 in the X axis direction that is the arraignment direction of the pressure generating chambers 21. However, the structure is valid when performing supply of ink from the center of the reservoir, and the invention is not limited to this.

Figure 9:
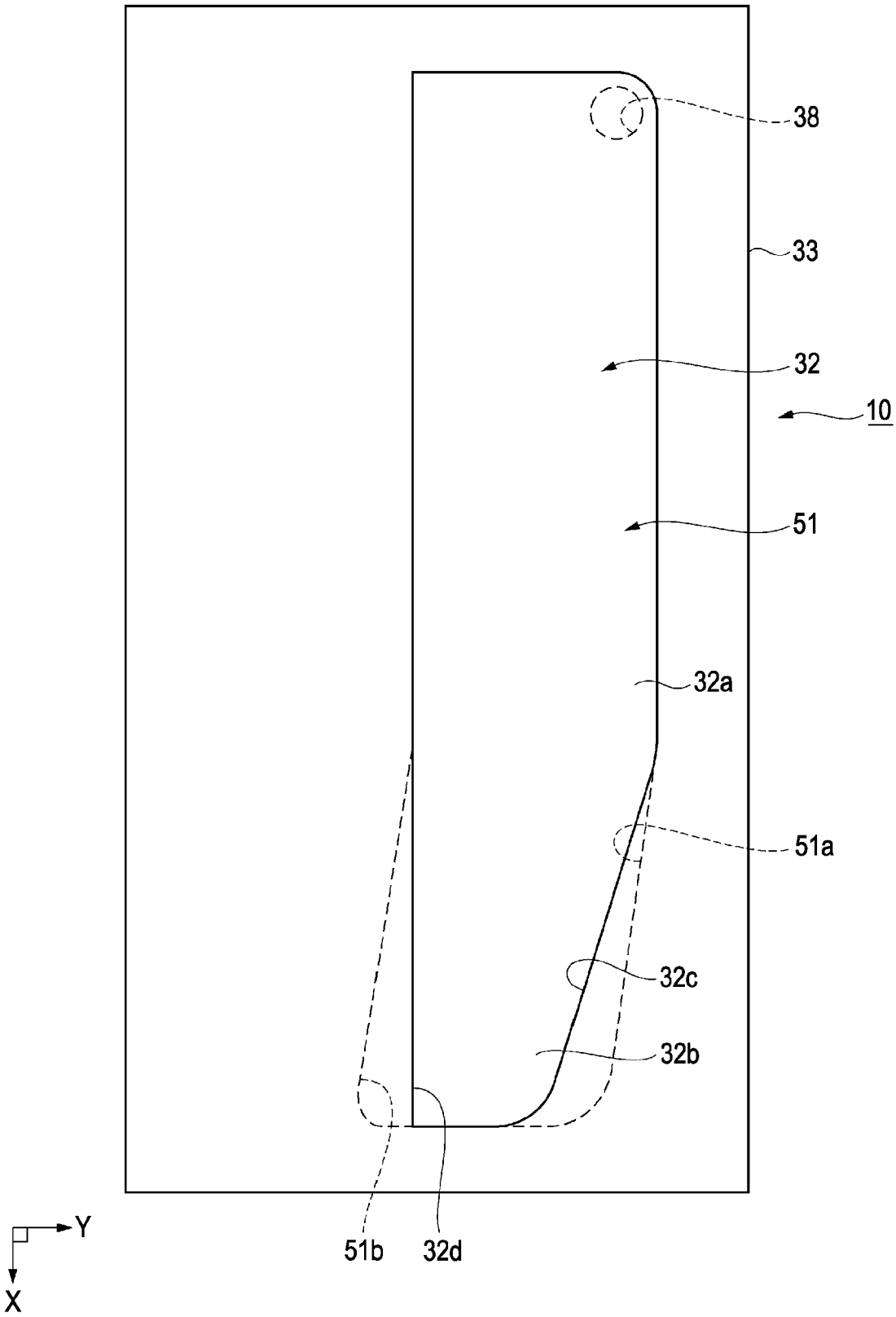
FIG. 9 is a plan view showing a main portion of an ink jet type recording head.

For example, FIG. 9 is a plan view schematically showing an ink jet type recording head 10 as an example. As shown in FIG. 9, in the structure in which ink is supplied from any one end side of the reservoir 32 in the arrangement direction of the pressure generating chambers 21, the second area 32*b* is not provided at the side at which ink is supplied, and the second area 32*b* is provided only at the other side.

Figure 10:
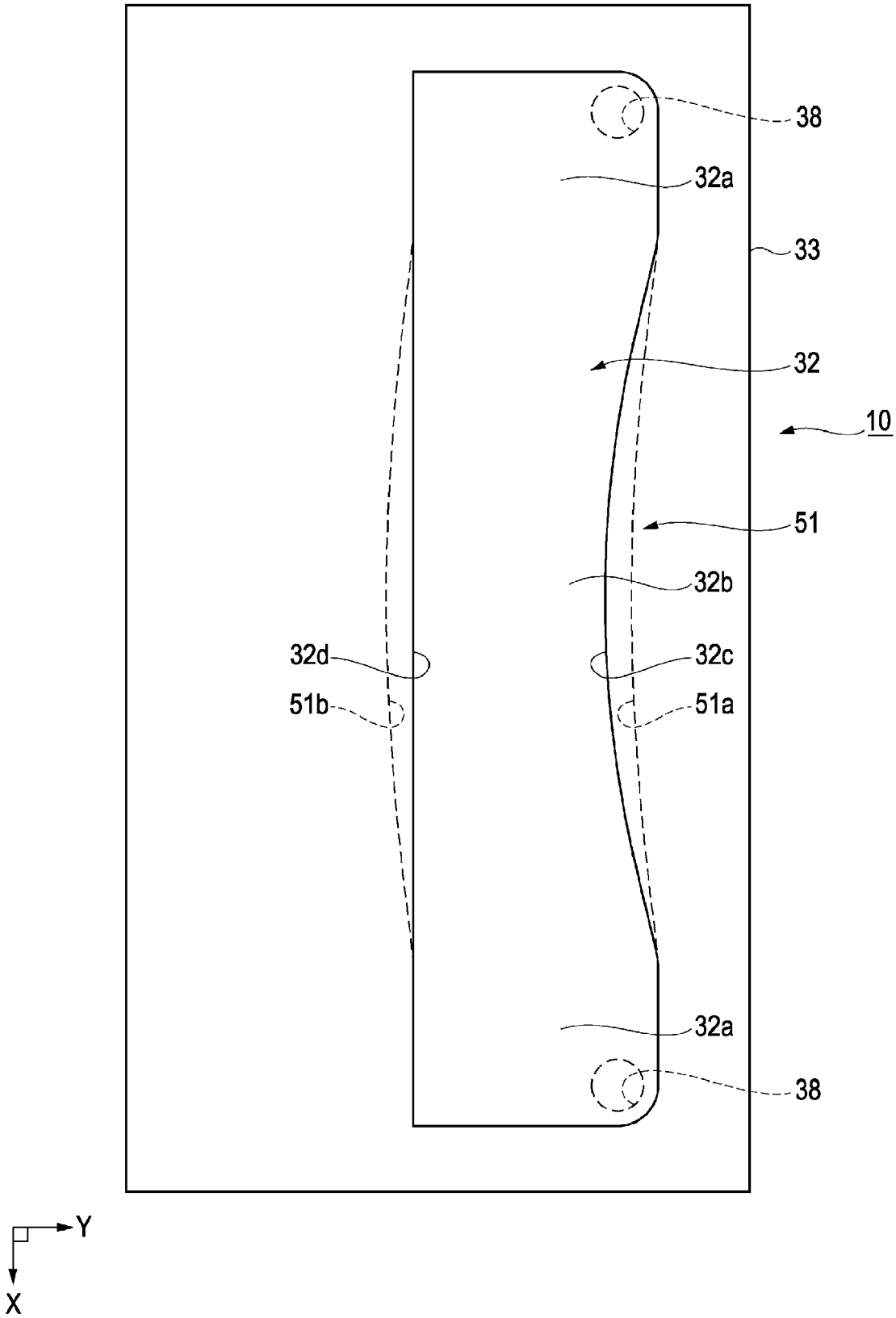
FIG. 10 is a plan view showing a main portion of an ink jet type recording head.

FIG. 10 is a plan view schematically showing an ink jet type recording head 10 according to another example. As shown in FIG. 10, in the structure in which ink is supplied from the both end of the reservoir 32 in the arrangement direction of the pressure generating chambers 21, a portion apart from the two liquid introduction ports 38 may be the second area 32*b*. Further, the number of the liquid introduction ports 38 is not limited to two and ink may be supplied from a plurality of places.

Further, in the embodiments, the adhesive layer 60 in the second area 32*b* is provided so as to be apart from the same distance from each end face 32*c* and 32*d* in the second area 32*b* in the Y axis direction perpendicular to the arrangement direction of the pressure generating chambers 21. Herewith, in the Y axis direction, the ends 51*a* and 51*b* of the compliance unit 51 in the second area 32*b* are provided so as to be apart from the same distance from each end face 32*c* and 32*d* opposing in the Y direction. However, the structure is employed for eliminating occurrence of unevenness in retaining of bubbles. Accordingly, in the case where it is not specifically necessary to consider the unevenness of retaining of bubbles, the structure is not limited to this.

Further, in the embodiments, the ink jet type recording head having the piezoelectric element 40 of a thick film type is exemplified. However, as for pressure generating means for generating pressure change in the pressure generating chamber 21, this is not specifically limited. The same effects can be obtained also by an ink jet type recording head having, for example, a piezoelectric element of a thin film type having a piezoelectric material that is formed by a sol-gel method, an MOD method, a spattering method, or the like, a piezoelectric element of a vertical vibration type in which a piezoelectric material and an electrode forming material are alternately laminated, the piezoelectric element being extended and contracted in the axis direction, an electrostatic actuator in which a diaphragm and an electrode are disposed with a predetermined gap, the electro static actuator controlling vibration of the diaphragm by an electrostatic force, or the one that ejects a liquid drop from a nozzle orifice by bubbles generated by heat of a heater element disposed in a pressure generating chamber.

In the first embodiment, the ink jet type recording head is exemplified as an example of a liquid ejecting head. However, the invention is widely applicable to all sorts of liquid ejecting heads, and it goes without saying that the invention can be applied to a method for examining a liquid ejecting head that ejects liquid except ink. As another liquid ejecting head, there are included, for example, various recording heads used for an image recording apparatus such as a printer or the like, a color material ejecting head used for manufacturing a color filter for a liquid crystal display or the like, an electrode material ejecting head used for forming an electrode for an organic EL display, an FED (field emission display) or the like, a bio-organic matter ejecting head used for manufacturing biochips, and the like.

The entire disclosure of Japanese Patent Application No. 2008-063747, filed Mar. 13, 2008 is incorporated by reference herein.

The entire disclosure of Japanese Patent Application No. 2008-286218, filed Nov. 7, 2008 is incorporated by reference herein.

What is claimed is:

1. A liquid ejecting head comprising:

a plurality of pressure generating chambers that are communicated with corresponding one of nozzle orifices that eject liquid, the plurality of pressure generating chambers being arranged in parallel;

a first substrate having a reservoir unit constituting at least a part of a reservoir that is a common liquid chamber that supplies the liquid to the plurality of pressure generating chambers; and a second substrate having a compliance unit that absorbs pressure change, the second substrate being combined with one surface of the first substrate via an adhesive layer, wherein the reservoir unit is provided over the pressure generating chambers in an arrangement direction of the pressure generating chambers, and the reservoir unit has a first area and a second area whose width in a direction perpendicular to the arrangement direction of the pressure generating chambers is smaller than a width of the first area, the compliance unit is provided to seal the reservoir unit and the surrounding of the compliance unit is fixed by the adhesive layer, and a width of the compliance unit corresponding to the second area of the reservoir unit is formed so as to be larger than the width of the second area, wherein a distance between an end face of the reservoir unit and the adhesive layer in the second area becomes larger as the width of the reservoir unit becomes smaller.

2. The liquid ejecting head according to claim 1, wherein the width of the compliance unit corresponding to an area of the reservoir unit that is opened to the pressure generating chambers is constant.

3. The liquid ejecting head according to claim 1, wherein a distance between one end face of the reservoir unit in the second area in the direction perpendicular to the alignment direction of the pressure generating chambers and the adhesive layer outside the end face and a distance between the other end face and the adhesive layer outside the other end face are the same.

4. A liquid ejecting apparatus comprising the liquid ejecting head according to claim 1.

5. A liquid ejecting head comprising:

a plurality of pressure generating chambers that are communicated with corresponding one of nozzle orifices that eject liquid, the plurality of pressure generating chambers being arranged in parallel;

a first substrate having a reservoir unit constituting at least a part of a reservoir that is a common liquid chamber that supplies the liquid to the plurality of pressure generating chambers; and a second substrate having a compliance unit that absorbs pressure change, the second substrate being combined with one surface of the first substrate via an adhesive layer, wherein the reservoir unit is provided over the pressure generating chambers in an arrangement direction of the pressure generating chambers, and the reservoir unit has a first area and a second area whose width in a direction perpendicular to the arrangement direction of the pressure generating chambers is smaller than a width of the first area, the compliance unit is provided to seal the reservoir unit and the surrounding of the compliance unit is fixed by the adhesive layer, and a width of the compliance unit corresponding to the second area of the reservoir unit is formed so as to be larger than the width of the second area, wherein a distance between one end face of the reservoir unit in the second area in the direction perpendicular to the alignment direction of the pressure generating chambers and the adhesive layer outside the end face and a distance between the other end face and the adhesive layer outside the other end face are the same.

* * * * *